United States Patent [19]

Berfield et al.

[11] Patent Number: 4,709,436

[45] Date of Patent: Dec. 1, 1987

[54] DEBRIS PAN FOR ROTARY BRUSH SWEEPER

[75] Inventors: Robert C. Berfield, Jersey Shore; Craig A. Seasholtz, Avis; Richard M. Fegan, Cogan Station, all of Pa.

[73] Assignee: Shop-Vac Corporation, Williamsport, Pa.

[21] Appl. No.: 919,856

[22] Filed: Oct. 16, 1986

Related U.S. Application Data

[63] Continuation-in-part of Ser. No. 826,545, Feb. 2, 1986, abandoned.

[51] Int. Cl.[4] ..... A47L 11/22

[52] U.S. Cl. ..... 15/79 R; 15/41 R; 15/83; 15/257.9

[58] Field of Search ..... 15/41 R–46, 15/48, 49 C, 50 C, 52, 83, 79 R, 79 A, 98, 383, 257.9; 294/56

[56] References Cited

U.S. PATENT DOCUMENTS

| | | | |
|---|---|---|---|
| 481,269 | 8/1892 | Thompson . | |
| 552,887 | 1/1896 | Branth . | |
| 688,189 | 12/1901 | Mason . | |
| 850,777 | 4/1907 | Mosher . | |
| 907,755 | 12/1908 | DeSpain . | |
| 984,336 | 2/1911 | Woodbury . | |
| 998,544 | 7/1911 | Mosher . | |
| 1,057,949 | 4/1913 | Ekre . | |
| 1,849,941 | 3/1932 | Lofstrand . | |
| 2,101,133 | 12/1937 | Dilliard | 15/41 R |
| 2,178,917 | 11/1939 | Pullen | 15/41 R |
| 2,205,249 | 6/1940 | Fitzgerald et al. . | |
| 2,206,429 | 7/1940 | Redfearn | 15/41 R |
| 2,670,485 | 3/1954 | Gomez . | |
| 2,689,367 | 9/1954 | Parker . | |
| 2,783,487 | 3/1954 | Luders | 15/41 A |
| 2,834,034 | 5/1958 | Angell . | |
| 2,986,755 | 6/1961 | Sobie et al. . | |
| 3,048,868 | 8/1962 | Clark . | |
| 3,284,830 | 11/1966 | Kroll . | |
| 4,071,920 | 2/1978 | Block . | |
| 4,219,897 | 9/1980 | Leibscher | 15/41 R |
| 4,366,593 | 1/1983 | Parikh . | |

FOREIGN PATENT DOCUMENTS

| | | | |
|---|---|---|---|
| 2845212 | 10/1979 | Fed. Rep. of Germany | 15/79 A |
| 147101 | 6/1930 | Switzerland . | |

*Primary Examiner*—Edward C. Roberts

*Attorney, Agent, or Firm*—Ostrolenk, Faber, Gerb & Soffen

[57] ABSTRACT

A rotary brush sweeper includes a debris pan with an inlet portion that glides on a surface being cleaned. The debris pan automatically disengages from the sweeper upon being engaged by an obstacle in the path of the sweeper. The debris pan is configured with an inlet portion or scoop for directing debris propelled by a rotary brush into the debris pan. The scoop portion has a first upwardly and rearwardly inclined surface and a second surface beneath the first surface and facing downwardly. A low friction material covers the first and second surfaces of the scoop to facilitate collection of debris into the debris pan. The covering may include an integrally formed tip portion of abrasion-resistant material, and is preferably configured in cooperation with the scoop to mechanically grip onto the scoop without the need for screws or adhesives.

23 Claims, 7 Drawing Figures

96
96c
98
142
140
94
97
16
22
76
84
12
92
80
20
130
200
18

96
98
142
97
140
95
94

DEBRIS PAN FOR ROTARY BRUSH SWEEPER

CROSS-REFERENCE TO RELATED APPLICATION

This is a continuation-in-part of application Ser. No. 826,545 filed on Feb. 2, 1986, now abandoned.

BACKGROUND OF THE INVENTION

The present invention relates to a rotary brush sweeper including a debris pan having an inlet or scoop portion that may pass over a surface to be cleaned in close proximity thereto, and more particularly to the construction of a debris pan with a scoop portion.

Rotary brush sweepers are equipped with debris pans for collection of debris swept into the pans by the rotary brush. To assure highly effective cleaning of a surface by such a sweeper, it would be desirable for the front of the debris pan, constituting an inlet portion, to pass over a surface being cleaned in close proximity thereto. It would be particularly desirable for the inlet portion of the debris pan to actually glide on a surface being cleaned for maximum cleaning results.

It would further be desirable, for facilitating the passage of debris into the debris pan, to cover the inlet portion of the debris pan with low friction material, such as vinyl. It would be further desirable that such low friction material be constructed in such manner that it may be readily mounted onto a debris pan by an unskilled worker, without the use of adhesive or screws or the like.

SUMMARY OF THE INVENTION

It is, accordingly, an object of the present invention to provide a rotary brush sweeper including a debris pan having an inlet portion which passes over a surface to be cleaned in close proximity thereto or which actually glides on such surface.

A further object of the invention is to provide a debris pan for a rotary brush sweeper in which an inlet portion of the pan is covered with low friction material to facilitate passage of debris through the inlet portion and into the pan.

Another object of the invention is to provide a debris pan for a rotary brush sweeper having a low friction covering on an inlet portion of the pan wherein such low friction covering is configured in such a manner as to be easily mounted onto the inlet portion of the pan without adhesives or screws or the like.

A still further object of the invention is to provide a debris pan for a rotary brush sweeper in which a low friction covering on an inlet portion to the pan is provided with an abrasion-resistant portion to prolong the lifetime of the covering.

Yet another object of the invention is to provide a debris pan for a rotary brush sweeper including a gliding portion situated rearwardly of an inlet portion for minimizing wear and damage to the inlet portion.

The invention relates to a rotary brush sweeper for removing debris from a surface. Such a sweeper includes a housing having front and rear portions with respect to movement of the sweeper. A brush is rotatably supported by the housing, and drive means are included for rotating the brush. The sweeper includes a debris pan situated rearwardly of the brush for collection of debris swept thereinto by the brush. A pan support means supports the debris pan with respect to the housing but permits an inlet portion of the debris pan to pass over a surface being cleaned in close proximity thereto. The inlet portion to the debris pan includes a scoop with a first surface inclined upwardly and rearwardly with respect to normal forward movement of the sweeper for directing debris into the pan. The scoop includes a second surface beneath the first surface and facing downwardly at any surface to be cleaned. The scoop is provided with a covering of low friction material over the first and second surfaces.

The covering of low friction material is preferably configured to mechanically grip onto the inlet portion, and to this end, may include a downwardly inclined portion situated on the leeward side of the first surface of the scoop, and an upwardly extending ridge adapted to fit within a corresponding groove in the first surface of the scoop. The covering advantageously includes an abrasion-resistant tip region located at the front of the scoop for retarding wear of the covering. Such abrasion-resistant region may be coextruded with the remainder of the covering so as to be integrally bonded to such remainder and provide lowcost construction.

The invention will be better understood and its various objects and advantages will be more fully appreciated from the following description taken in conjunction with the accompanying drawings.

DESCRIPTION OF THE PREFERRED EMBODIMENTS

Figure 1:
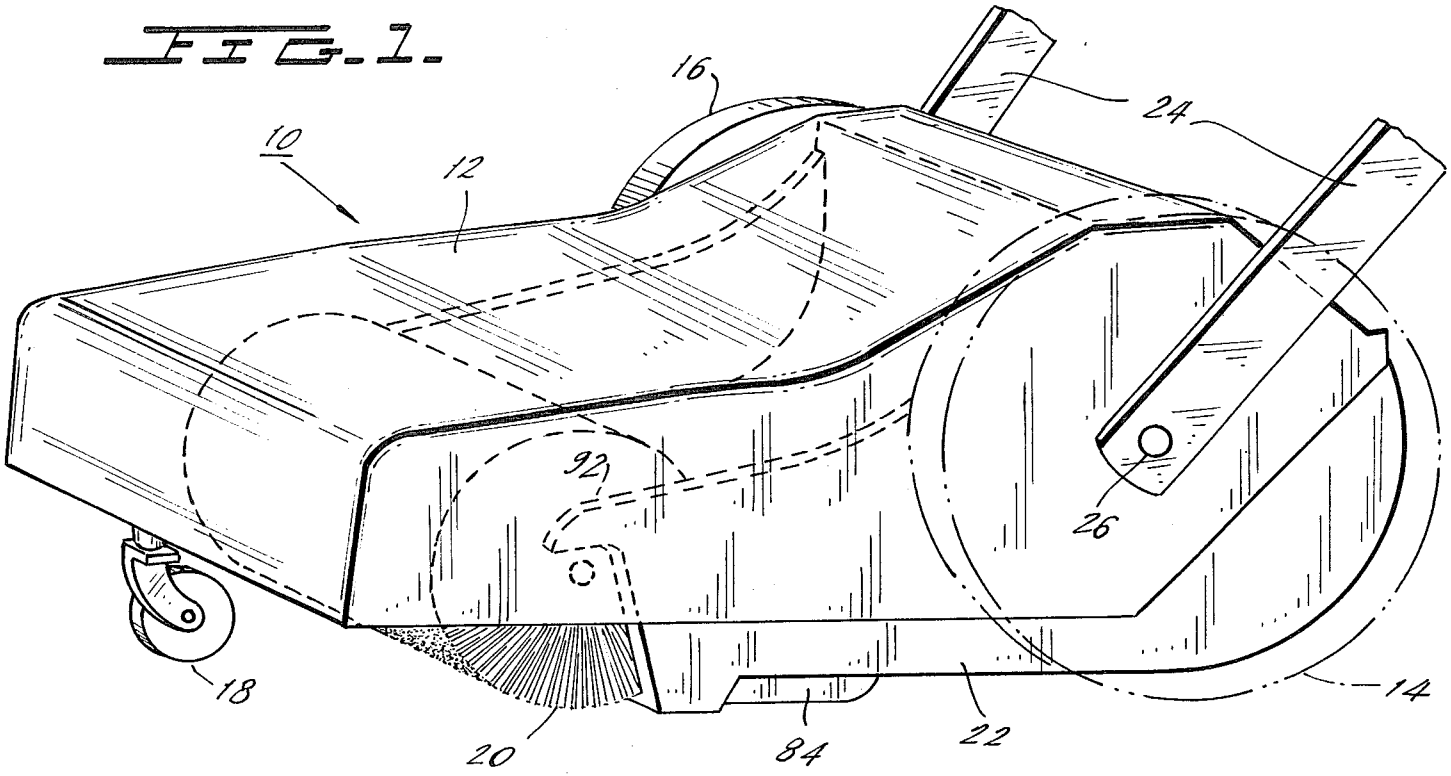
FIG. 1 is a simplified view in perspective of a rotary brush sweeper in accordance with the present invention, and illustrates selected parts of the sweeper.

Referring to the drawings, FIG. 1 illustrates selected parts of a rotary brush sweeper 10 in accordance with the present invention. Sweeper 10 includes a housing 12 of plastic, for example, onto which a pair of rear wheels 14 and 16 and a front wheel 18 are mounted. Wheels 14, 16 and 18 are shown schematically in FIG. 1. Preferably, rear wheels 14 and 16 each comprises a rubber tire mounted on a plastic hub, and front wheel 18 comprises a caster.

Rotary brush 20, preferably of the type having a twisted wire axle, is rotatably mounted onto housing 12 behind front wheel 18. Situated immediately behind rotary brush 20 (i.e., to the right in FIG. 1) is a debris pan 22 which collects debris that is swept into the pan by rotary brush 23. Debris pan 22 is described in more detail hereinafter.

A handle 24 is attached to housing 12. Handle 24 includes a yoke portion (not shown) which may be conveniently grasped manually. Handle 24 may be conveniently mounted on axle 26 for rear wheel 14, for example.

Figures 2, 2A:
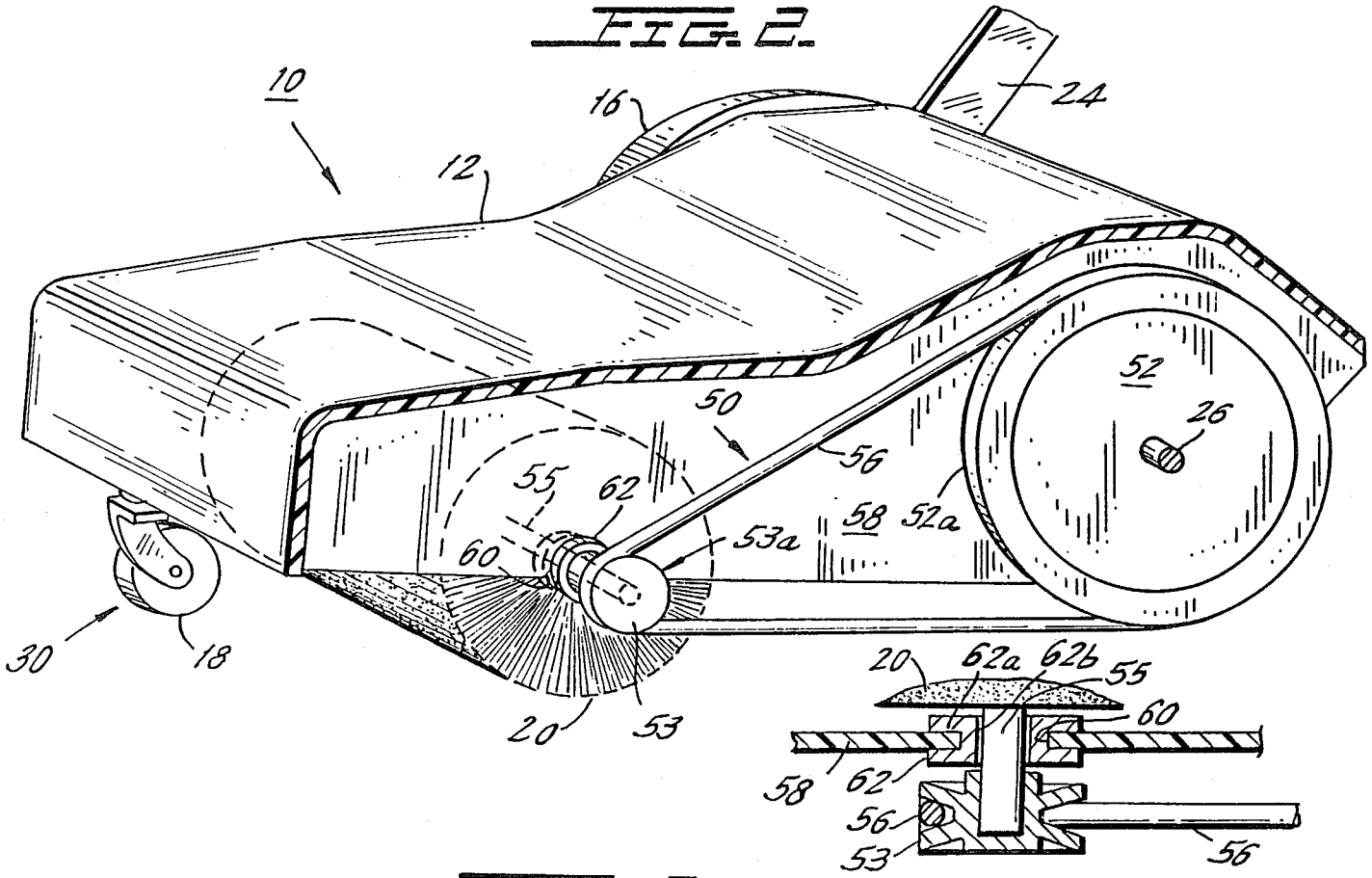
FIG. 2 is a perspective view of the rotary brush sweeper of FIG. 1 with various portions removed or cut away to better illustrate a drive mechanism of the sweeper.
FIG. 2A is a detailed view in cross section of the axle support arrangement of FIG. 2, further illustrating a bushing that may be provided between the axle of the rotary brush and a portion of the housing that supports the axle.

FIG. 2 depicts rotary brush sweeper 10 with various portions removed or cut away to expose a drive system 50 for rotating rotary brush 20. Drive system 50 includes a drive pulley 52 fixedly mounted on rear axle 26, on which wheel 14 (FIG. 1) is also fixed, such that rotation of wheel 14 rotates drive pulley 52. The other rear wheel is free to idly revolve about rear axle 26. Drive system 50 also includes a driven pulley 53 so that rotary brush 20 is rotated at a higher rate than drive wheel 14 (FIG. 1). An endless rubber belt 56 that is slightly elastic is mounted under tension in respective circumferential grooves 52*a* and 53*a* on pulleys 52 and 53 and this transfers rotational movement of drive pulley 52 to drive pulley 53.

Further illustrated in FIG. 2 is a support panel 58, which depends from the upper portion of housing 12 and which supports the left-hand, or "drive", ends of rear axle 26 and rotary brush axle 55. The opposite, or right-hand, ends of axles 26 and 55 (not shown) are suitably supported by conventional bushings that permit free rotation of the axles. Rear axle 26 may be supported by panel 58 by extending through an aperture (not shown) in the panel, without a bushing for the axle. Support panel 58 includes a notch 60 in which axle 55 is received. The axle preferably is received in a bushing 62 mounted in notch 60. Notch 60 extends rearwardly and upwardly in support panel 58 from its opening. This simple mounting arrangement provided by notch 60 enables insertion of axle 55 into notch 60 and enables securement of the axle in position in the notch by belt 56 when the belt is under tension due to its mounting on pulleys 52 and 53.

Referring to FIG. 2A, bushing 62 between rotary brush axle 55 and support panel 58 has flat bottom grooves 62*a* on its opposite edges and these receive the portions of the support panel 58 forming the sides of notch 60, which prevents rotation of the bushing. The bushing includes an aperture 62*b* through which brush axle 55 extends. Bushing 62 may be of low-friction plastic or other low friction material.

Figures 3, 4:
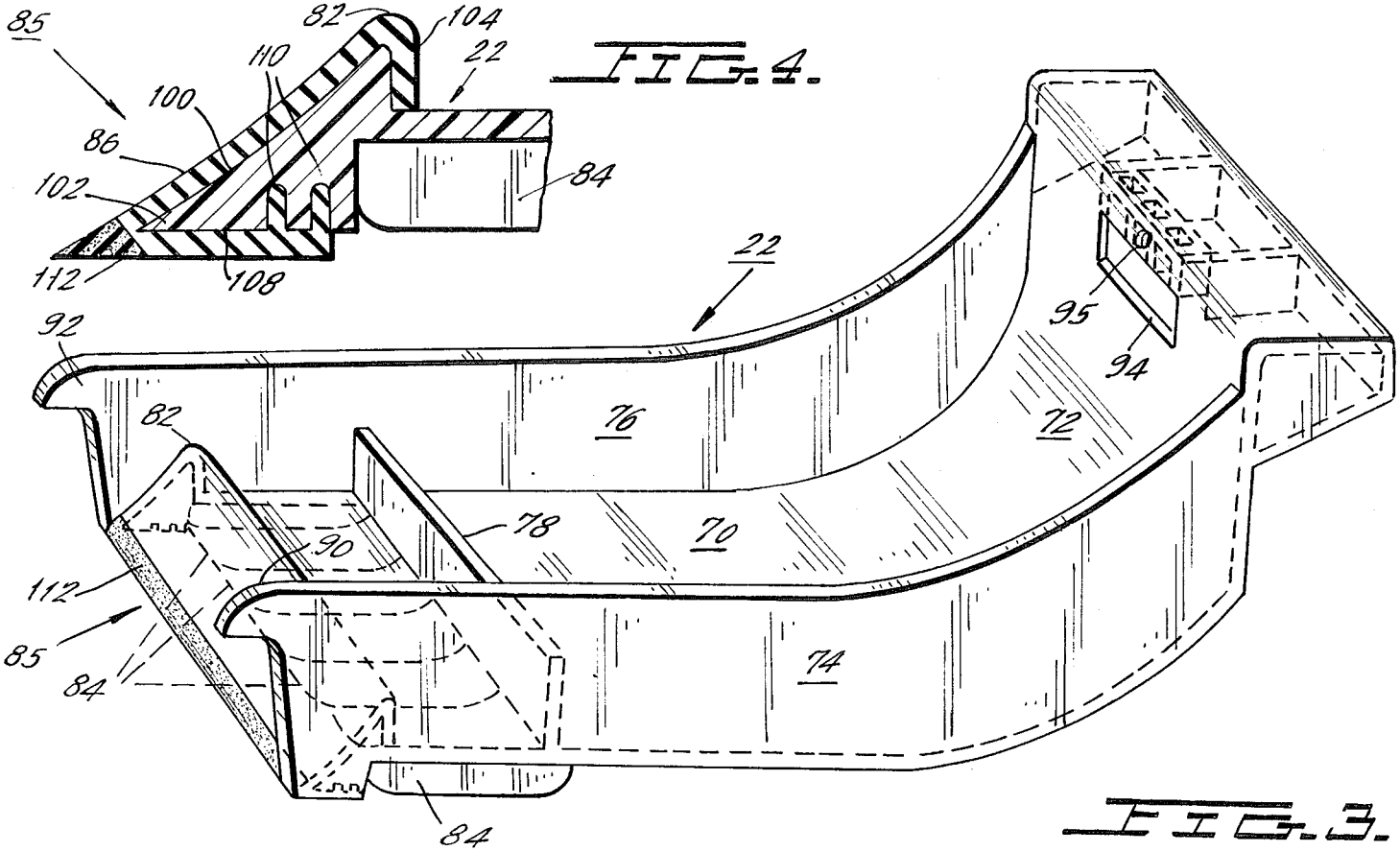
FIG. 3 is a perspective view of an exemplary debris pan in accordance with the invention.
FIG. 4 is a detailed view of an inlet portion of the debris pan of FIG. 3.

Debris pan 22 is partially shown in FIG. 1 and shown in detail in FIG. 3. Debris pan 22 is rigid and may be of metal or plastic, such as polypropylene. Debris pan 22 includes a flat bottom 70, a curving rear wall 72 into which the bottom 70 merges, and confronting sides 74 and 76. Sides 74 and 76 are joined to bottom 70, curving rear wall 72, and confronting sides 74 and 76. Sides 74 and 76 cooperate with bottom 70 and rear wall 72 to form an open topped enclosure in which debris is collected. The top of housing 12 completes that enclosure. A rib 78 extends upwardly from pan bottom 70 and from side 74 to side 76. Rib 78 separates the interior of debris pan 22 into separate bins so as to minimize shifting of any debris in debris pan 22.

The front of pan bottom 70 comprises a scoop portion 85, which is configured in arcuate fashion to facilitate sweeping of debris into debris pan 22. The upper edge of scoop portion 85 comprises a ridge 82 extending between pan sides 74 and 76, and, together with lateral rib 78, scoop portion 85 forms a forward bin in debris pan 22. It is preferred that scoop portion 85 at the front of the pan include a covering of low friction material 86, as shown in the detail view of scoop portion 85 in FIG. 4. Layer 86 may comprise vinyl, by way of example. Layer 86 enhances the gliding of the pan over a surface being cleaned and protects the front of the pan from excessive damage and wear.

In accordance with an important feature of the present invention, covering 86 extends along the upwardly and rearwardly inclined surface 100 of pan 22 from a forward tip 102 of the pan to ridge 82 of the pan and then downwardly on the leeward side of the scoop, as at 104, to aid covering 86 in mechanically gripping onto scoop region 85 of the pan. Covering 86 preferably extends from tip portion 102 of pan 106 along the underside 108 of the scoop portion 85. Underside 108 preferably includes one or more grooves 110 into which corresponding ridges of covering 86 extend, as illustrated in FIG. 4.

Covering 86 may beneficially include a tip portion 112 of high abrasion resistance material, such as polyurethane. Tip portion 112 may advantageously be coextruded with the remainder of covering 86 so as to form a unitary and inexpensive part. Covering 86 may be held on scoop portion 85 solely from mechanical gripping of such portions. To this end, covering 86 is preformed to maintain its shape as illustrated, and the ridges of the covering received within grooves 110 are formed to be oversized and then are squeezed into such grooves. Covering 86, accordingly, can be easily mounted on scoop portion 85 of debris pan 22, and is inexpensive and durable in construction.

Adjoining the underside of pan bottom 70 is a plurality of front-to-rear extending rails 84 which are intended to glide upon a surface being cleaned, while setting the usual height of the front of scoop 85. The rails 84 extend downwardly at least as far as the bottom of covering 86 (FIG. 4) so as to bear a substantial portion of the weight of debris pan 22 relative to scoop portion 85. A resulting benefit is the reduction in wear of covering 86 of scoop portion 85.

Debris pan 22 includes various features used in supporting the pan within housing 12 (FIG. 1) of sweeper 10. Pan 22 includes an aperture 94 through which a cooperating member of housing 12 is intended to protrude, as described below. An additional aperture 95 is provided above aperture 94. The aperture 95 cooperates with a detent in housing 12, described below, so that pan 22 is supported by the housing in a sturdy fashion.

The front of pan 22 includes laterally-projecting members 90 and 92 which extend forwardly from pan sides 74 and 76, respectively. The members 90 and 92 are adapted to rest on a cooperating support structure mounted on housing 12, as described below.

Figures 5, 6:
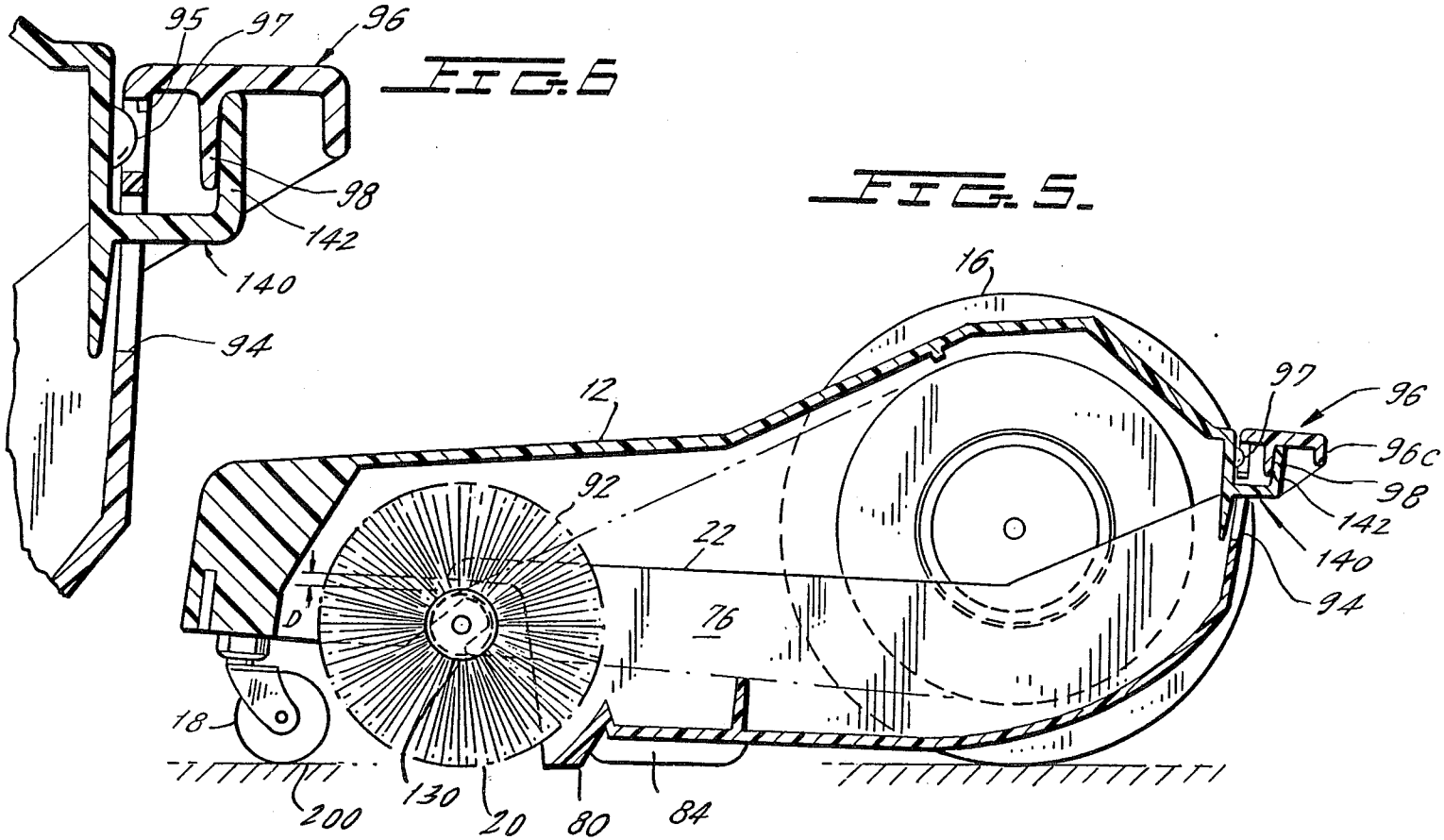
FIG. 5 is a side plan view of the rotary brush sweeper of the invention illustrating a support means for the debris pan.
FIG. 6 is a detailed view of a rear support arrangement for the debris pan shown in FIG. 5.

FIG. 5 illustrates the mounting of debris pan 22 to housing 12. Front support member 92 is normally disposed by a distance "D" above a cooperating support member 130 mounted on the inner side of housing 12. Support element 130 may suitably comprise a bushing in which the far end of brush axle 55 (FIG. 2) is received. The other front support member 90 (not shown in FIG. 5), similarly, is normally situated above a support element corresponding to element 130, which may comprise a bushing unit into which the nearer end of the brush axle is received. The clearance "D" allows the pan to glide over surface 200, even if the contour of the surface changes. Support element 92 rests on support element 130 when the front of the sweeper is lifted, for example, to prevent debris from falling away from housing 12.

To support the rear of debris pan 22, a rearwardly projecting tab 140 protrudes through aperture 94 of the debris pan. Thus, housing tab 140 supports the rear of pan 22.

To hold debris pan 22 sturdily in position, rearwardly projecting detent 97 is provided in housing 12. The detent passes into aperture 95 (FIG. 6) in the pan. To bias detent 97 into the aperture, upwardly projecting portion 142 of housing tab 140 pulls against downwardly projecting flange 98 of debris pan 122.

The foregoing describes a rotary brush sweeper having a debris pan that may glide over a surface to be cleaned. The pan automatically disengages from the sweeper should the pan become snagged by an obstacle on the surface. The pan includes an inlet, or scoop portion, covered with low friction material to facilitate sweeping of debris into the pan. The covering may be configured in such a way as to be mounted on an inlet portion of the pan by mere mechanical gripping of the covering onto the inlet portion. The covering may include an integrally formed abrasion-resistant tip portion to prolong the life of the covering.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A debris pan for a sweeper, comprising a pan body including an inlet portion for receiving debris propelled into the pan by the sweeper, the inlet portion being configured to be moved over a surface to be cleaned in close proximity thereto for normal cleaning operation; the inlet portion including a scoop with a first surface inclined upwardly and rearwardly, with respect to forward sweeper movement, for directing debris into the pan, and a second surface beneath the first surface and facing downwardly at any surface to be cleaned; the first and second surfaces of the scoop being provided with a covering of low friction material configured to mechanically grip onto the inlet portion.

2. The debris pan of claim 1, wherein the upper portion of the first surface forms a ridge and the covering includes a portion which extends over and downwardly on a leeward side of the ridge to enhance gripping of the covering onto the inlet portion.

3. The debris pan of claim 1, wherein the second surface includes a groove and the covering includes an upwardly extending ridge of material adapted to fit tightly into the groove.

4. The debris pan of claim 3, wherein the covering includes an abrasion-resistant region situated at the front end of the scoop for retarding wear of the covering.

5. The debris pan of claim 4, wherein the abrasion-resistant region is integrally bonded to the remainder of the covering.

6. The debris pan of claim 1, wherein:

the upper portion of the first surface forms a ridge and the covering includes a portion which extends over and downwardly on a leeward side of the ridge to enhance gripping of the covering onto the inlet portion; and the second surface includes a groove and the covering includes an upwardly extending ridge of material adapted for fitting tightly into the groove.

7. The debris pan of claim 1, wherein the pan body includes a gliding portion located rearwardly of the inlet portion, the gliding portion extending downwardly at least the same depth the inlet portion so as to bear a substantial portion of the weight of the debris pan, thereby to minimize wear of the covering on the inlet portion.

8. The debris pan of claim 1, wherein the covering includes an abrasion-resistant region situated at the front end of the scoop for retarding wear of the covering.

9. The debris pan of claim 8, wherein the abrasion-resistant region is integrally bonded to the remainder of the covering.

10. The debris pan of claim 1, wherein the covering is configured to attach to the inlet portion solely by mechanically gripping onto such portion.

11. A rotary brush sweeper from removing debris from a surface, comprising:

a housing having front and rear portions with respect to movement of the sweeper during sweeping:

a brush rotatably supported by the housing;

drive means for rotating the brush;

a debris pan situated rearwardly of the brush for collection of debris swept thereinto by the brush;

pan support means for supporting the debris pan relative to the housing but for permitting vertical displacement of the front of the pan by an amount sufficient to permit the front of the pan to contact and glide on the surface being cleaned, even when contour thereof changes;

the pan including an inlet portion for receiving debris propelled into the pan by the sweeper; the inlet portion including a scoop with a first surface inclined upwardly and rearwardly with respect to normal movement of the sweeper during sweeping for directing debris into the pan and a second surface beneath the first surface and facing downwardly at any surface to be cleaned; and a covering of low friction material provided on the first and second surfaces of the scoop and being configured to mechanically grip onto the inlet portion.

12. The rotary brush sweeper of claim 12, wherein the upper portion of the first surface forms a ridge and the covering includes a portion which extends over and downwardly on a leeward side of the ridge to enhance gripping of the covering onto the inlet portion.

13. The rotary brush sweeper of claim 12, wherein the second surface includes a groove and the covering includes an upwardly extending ridge of material adapted to fit tightly into the groove.

14. The rotary brush sweeper of claim 13, wherein the pan body includes a gliding portion located rearwardly of the inlet portion, the gliding portion extending downwardly at least the same depth as the inlet portion so as to bear a substantial portion of the weight of the debris pan, thereby to minimize wear of the covering on the inlet portion.

15. The rotary brush sweeper of claim 13, wherein the covering includes an abrasion-resistant region situated at the front end of the scoop for retarding wear of the covering.

16. The rotary brush sweeper of claim 15, wherein the abrasion-resistant region is integrally bonded to the remainder of the covering.

17. The rotary brush sweeper of claim 11, wherein:

the upper portion of the first surface forms a ridge and the covering includes a portion which extends over and downwardly on a leeward side of the ridge to enhance gripping of the covering onto the inlet portion; and the second surface includes a groove and the covering includes an upwardly extending ridge of material adapted for fitting tightly into the groove.

18. The rotary brush sweeper of claim 11, wherein the pan body includes a gliding portion located rearwardly of the inlet portion, the gliding portion extending downwardly at least the same depth as the inlet portion so as to bear a substantial portion of the weight of the debris pan, thereby to minimize wear of the covering on the inlet portion.

19. The rotary brush sweeper of claim 11, wherein the covering includes an abrasion-resistant region situated at the front end of the scoop for retarding wear of the covering.

20. The rotary brush sweeper of claim 19, wherein the abrasion-resistant region is integrally bonded to the remainder of the covering.

21. A debris pan for a sweeper, comprising a pan body including an inlet portion for receiving debris propelled into the pan by the sweeper, the inlet portion being configured to be moved over a surface to be cleaned in close proximity thereto for normal cleaning operation; the inlet portion including a scoop with a first surface inclined upwardly and rearwardly, with respect to forward sweeper movement, for directing debris into the pan; the scoop being provided with a covering of low friction material configured to mechanically grip onto the inlet portion; the covering including an abrasion-resistant region situated at the front end of the scoop for retarding wear of the covering.

22. The debris pan of claim 11, wherein the covering is configured to attach to the inlet portion solely by mechanically gripping onto such portion.

23. A rotary brush sweeper for removing debris from a surface comprising:

a housing having front and rear portions with respect to movement of the sweeper during sweeping:

a brush rotatably supported by the hosing;

drive means for rotating the brush;

a debris pan situated rearwardly of the brush for collection of debris swept thereinto by the brush;

pan support means for supporting the debris pan relative to the housing but for permitting vertical displacement of the front of the pan by an amount sufficient to permit the front of the pan to contact and glide on the surface being cleaned, even when the contour thereof changes;

the pan including an inlet portion for receiving debris propelled into the pan by the sweeper; the inlet portion including a scoop with a first surface inclined upwardly and rearwardly with respect to normal movement of the sweeper during sweeping for directing debris into the pan and a second surface beneath the first surface and facing downwardly at any surface to be cleaned; and a covering of low friction material provided on the first and second surfaces of the scoop; an abrasion-resistant region situated at the front end of the scoop for retarding wear of the covering.

* * * * *